United States Patent [19]

Hillier

[11] Patent Number: 4,683,174

[45] Date of Patent: Jul. 28, 1987

[54] RAW CASTING BLANK FOR FLUID ACTUATED RAM ASSEMBLY

[75] Inventor: Raymond G. Hillier, Queensland, Australia

[73] Assignee: Delibes Pty. Ltd., Australia

[21] Appl. No.: 784,246

[22] Filed: Oct. 4, 1985

[30] Foreign Application Priority Data

Oct. 5, 1984 [AU] Australia ..... PG7524
Nov. 13, 1984 [AU] Australia ..... PG8094
Jun. 14, 1985 [AU] Australia ..... PH1034

[51] Int. Cl.[4] ..... B22D 25/02

[52] U.S. Cl. ..... 428/583; 428/577; 428/586; 428/587

[58] Field of Search ..... 92/164, 168, 110, 163, 92/118; 29/156.5 R, 156.7 C, DIG. 5; 164/369, 76.1; 428/577, 583, 584, 585, 586, 587, 599

[56] References Cited

U.S. PATENT DOCUMENTS 2,126,893 8/1938 Klamp ..... 428/586
2,274,667 3/1942 Colwell ..... 29/DIG. 5
3,335,642 8/1967 Rosaen ..... 92/110
3,543,643 12/1970 Southwell ..... 92/168
4,337,687 7/1982 Hoover ..... 92/164
4,342,257 8/1982 Weyer ..... 92/110
4,384,511 5/1983 Mefford ..... 92/168

*Primary Examiner*—L. Dewayne Rutledge
*Assistant Examiner*—John J. Zimmerman
*Attorney, Agent, or Firm*—Renner, Otto, Boisselle & Lyon

[57] ABSTRACT

A raw casting for a metallic article such as a hydraulically actuated ram assembly, which has a rear portion having a bifurcated end as well as front portion having a bifurcated end. The raw casting may also include a barrel portion having an internal bore. The rear portion may serve as a precursor for a rear end cap and associated clevis of the hydraulically actuated ram assembly and the front portion may serve as a precursor for the rod clevis of the hydraulically actuated ram assembly which may be screw threadedly attached to a piston rod or piston of the hydraulically actuated ram assembly.

7 Claims, 24 Drawing Figures

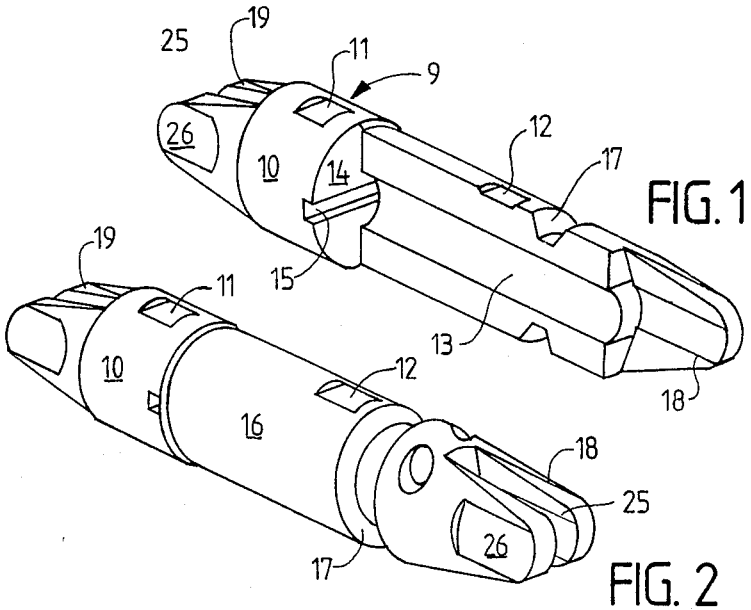
FIG. 1
FIG. 2
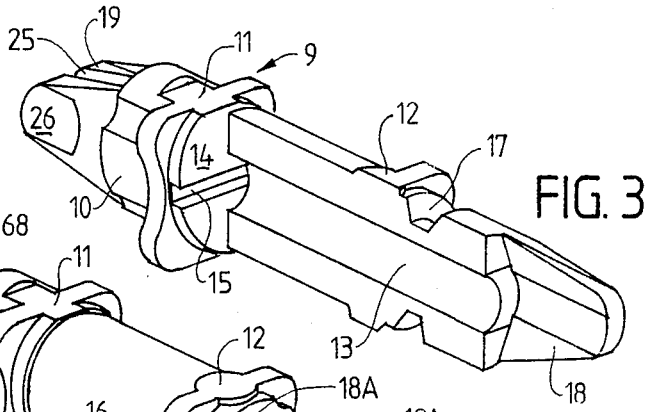
FIG. 3
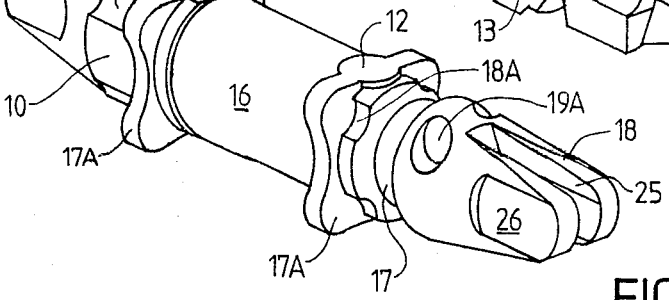
FIG. 4

30
18
32
37
38
33

30
39
43
18
41
40
42
33

30
44
47
45
18
46
33
48
31

30
49
31

RAW CASTING BLANK FOR FLUID ACTUATED RAM ASSEMBLY

This invention relates to a process for forming metallic articles such as fluid actuated ram assemblies from an initial raw casting wherein components of the article may be produced "in situ" before being separated from the raw casting by subsequent machining, drilling or cutting operations.

Hitherto fabrication methods for production of metallic articles such as fluid actuated ram assemblies have been formed in separate casting or machining operations from various types of metals such as aluminum, iron (including malleable or ductile iron as well as spheroidal graphite (SG) iron and cast iron) and steel. This meant that each component is being produced separately and did not provide a manufacturing operation that was economically cost effective in relation to labour costs and time. It was also found that due to the different tolerances that were applicable that the components may not have been machined or formed properly with subsequent disadvantages in loss of accuracy owing to lack of concentricity or misalignment. It was also to be appreciated that having components formed separately meant that often components were manufactured in different locations and assembled at another location which substantially increased stock inventory and lead times in relation to manufacture of the various components of a metallic article.

It therefore is an object of the invention to provide a process for forming metallic articles from a raw casting which alleviates the abovementioned disadvantages of the prior art.

The process of the invention includes the steps of:

(1) producing an raw casting from a mould optionally having an internal bore; and (2) performing one or more transverse parting operations to said casting so as to form components of the article.

The initial raw casting in step (1) may be produced by an appropriate process. Thus in one form the casting operation may be carried out in a mould having a core associated therewith. The mould may have an internal mould cavity of complementary shape to the desired shape of the raw casting and the core or core pin may be located in the mould cavity having one end thereof extending into a core retaining recess at one end of the mould cavity. The molten metal as is usual with casting operations may be poured with the assistance of gravity into the mould cavity. Suitably the mould may be formed by an upper mould component or "cope" and a lower mould component or "drag". The core which is suitably formed from a mixture of sand and resin may be cast in the lower mould component part of the mould cavity and is responsible for forming an internal bore of the metal article of desired configuration.

In relation to the cavity process described above both the top mould component and the bottom mould component may be formed from pattern plates or pattern boxes as is known in the art. Usually there will also be provided one or more locating dowels between the top mould component and the bottom mould component and if necessary clamping between both top and bottom mould components may be effected by any appropriate means.

The casting which is produced by the abovementioned casting process may then be subsequently subjected to appropriate machining operations prior to division or parting off of the various components of the article. In relation to formation of grooves and the like in regard to the casting it is preferred that such grooves be formed in the casting operation rather then the subsequent machining operations.

Preferably the casting produced by the process of the invention is suitably designed for a fluid actuated ram assembly. Thus preferably the ram assembly will comprise a rear bifurcated end appropriate for functioning subsequently as a rear clevis attached to a rear end cap.

The casting may be dislodged from this mould in any suitable mannner such as being removed by inspection with a hammer or by gravity.

The casting may also comprise a rear portion having one or more locating portions or flats so as to define locations for one or more rear ports. The casting may also include the internal bore described above having an end wall formed by the rear portion. The said end wall may also include a locating and centering groove or rib which may act as a "tag" for the core. The groove or rib may comprise any suitable shape such as being square, round or rectangular. The casting may then include a cylinder or barrel portion containing the said internal bore and one or more locating portions or flats for defining one or more front ports. There also may be provided a groove which may function as a suitable boundary between a front bifurcated end which may be subsequently utilized as a clevis for the piston rod of the fluid actuated ram assembly and preferably the front end cap located frontwardly of the cylinder or barrel portion.

After formation of a casting as described above said casting may then be mounted on a lathe. Preferably the front end of the casting is attached to a lathe chuck although of course it is also possible to commence parting operations with respect to the casting by mounting the rear end of the casting in the lathe chuck which is mounted on a rotating mandrel associated with a headstock of the lathe. However the former arrangement is preferred.

The rear end of the casting is suitably supported in a rotatably mounted centering device associated with a tailstock of the lathe. However this is not essential and the centering device may be non-rotatably mounted to the tailstock if desired.

In the above described arrangement there also may be provided a turning tool or profiling tool mounted on a tool support or saddle of the lathe. The saddle may be automatically reciprocatable if desired or alternatively it may have an automatic initial stroke and manual return stroke. The tool support is suitably slidably mounted to the lathe so that it is adjustable transversely as well as longitudinally. The turning tool may be used to form the abovementioned boundary groove between the front bifurcated end and the front end cap although as stated previously this boundary groove may be formed in the casting operation if desired.

Preferably the turning tool which is stationary with respect to the rotating casting may be used to dress or fettle the exterior surface of the casting and in particular part of the casting adjacent the rear bifurcated end which suitably corresponds to part of a substantially all of the rear end cap.

Subsequently the casting may be removed from the lathe which is preferably an NC (numerically controlled) lathe and reversed so that the front clevis or rod clevis end is mounted in the tailstock and the rear clevis end is mounted in the chuck. At this stage the rod clevis end may be a pair of opposed holes formed in each fork or opposed part of the front bifurcated end by a suitably drilling tool and also a tapping tool associated with the tailstock of the lathe if a thread is required.

After this step the rod clevis may then be separated by a transverse parting operation or cutting operation carried out by a parting off tool attached to the saddle of the lathe.

The body of the casting may at the rod clevis end then be bored and grooved by a suitable boring tool and grooving tool respectively so as to form the front end cap which may be subsequently parted off from the body of the casting by a parting-off tool.

Subsequently the piston may be formed by a taper boring tool, turning and grooving tool as illustrated hereinafter before being parted from the casting by a parting-off tool. Finally the rear end cap may be formed by turning tool while still being mounted in the chuck of the lathe. The clevis holes of the rear end cap may also be formed subsequent to this step or alternatively by a drilling and tapping operation when the rod clevis end of the casting was mounted in the chuck of the lathe.

It will also be appreciated that the abovementioned sequence of steps need not be carried out in the aforementioned order and any suitable order or sequence may be adopted so as to form as separate components from the raw casting which include:

(i) the piston rod clevis
(ii) the front end cap
(iii) the piston, and
(iv) the rear end cap.

Following manufacture of the abovementioned components as described above a cylinder tube and piston rod may be manufactured or obtained from a suitable source and the complete ram assembly may be assembled in the following manner (1) the front end cap is welded to the cylinder tube after it is preferably reamed to allow for contraction during the welding process;
(2) the piston rod seal and rod wiper seal are fitted to the front end cap;
(3) the rod clevis is attached to the piston rod;
(4) the piston rod is passed through the internal bore of the front end cap and hence into the interior of the cylinder tube;
(5) the piston may be fitted with a piston seal and piston wear ring and passed into the cylinder tube through a rear end thereof and subsequently passed over an adjacent tapered end of the piston rod;
(6) a piston retaining nut may then be securely torqued to the piston rod;
(7) the piston may then be withdrawn to the front end of the cylinder tube, and
(8) the rear end cap may be positioned abutting the rear end of the cylinder tube and welded thereto.

Reference may now be made to a preferred embodiment of the invention as shown in the attached drawings wherein:

FIG. 1 is a partly broken away perspective view of the casting;

FIG. 2 is a perspective view of the casting of FIG. 1;

FIG. 3 is a partly broken away perspective view of a modified casting;

FIG. 4 is a perspective view of the casting of FIG. 3;

Figure 7:
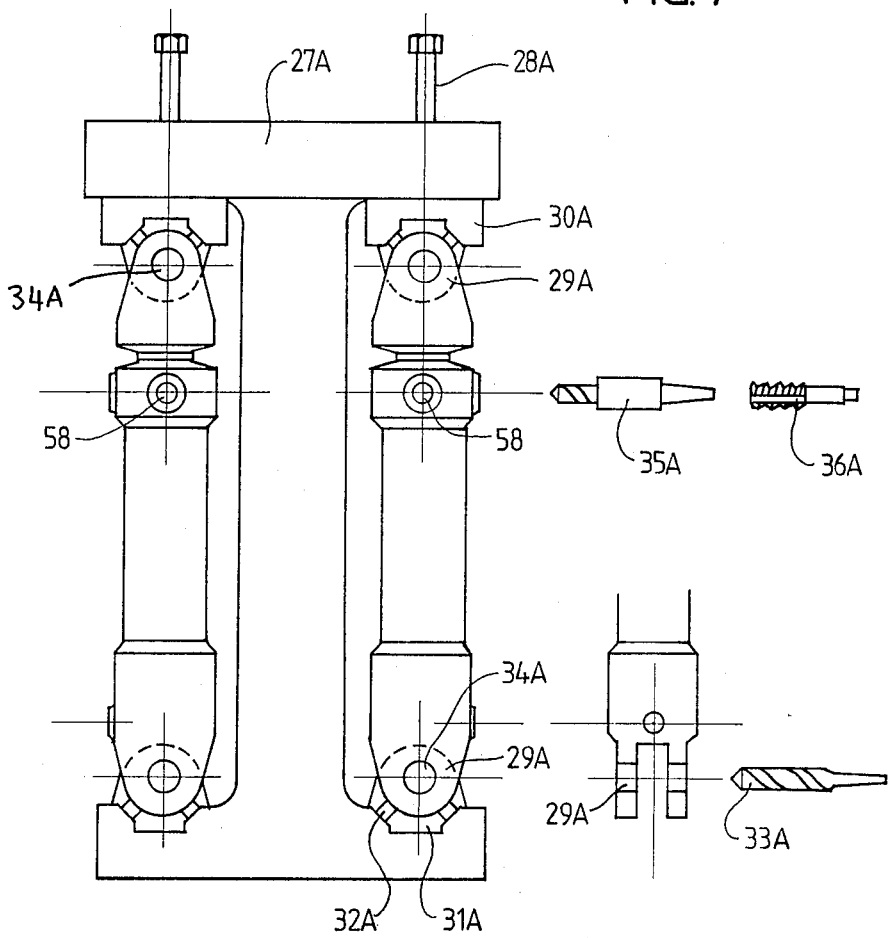
Figure 8:
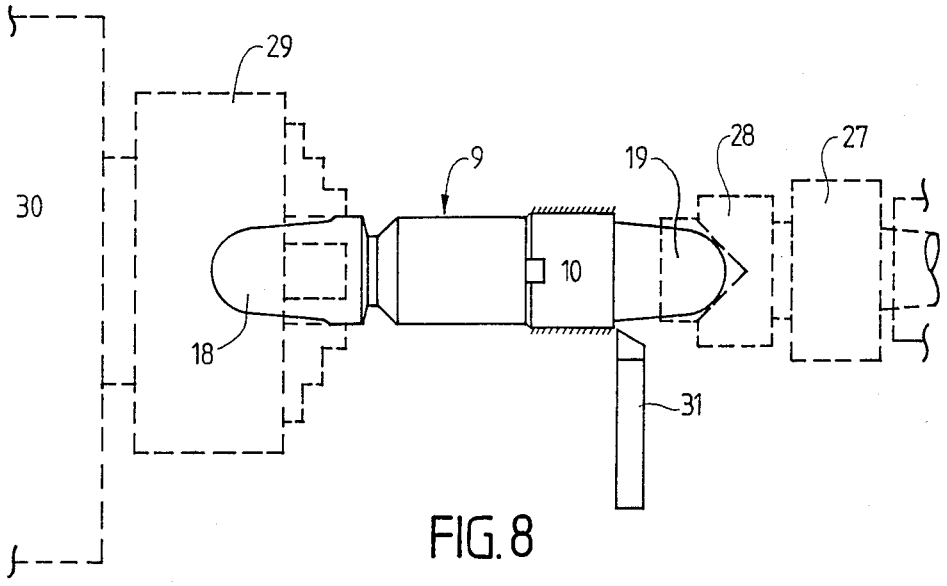
Figure 9:
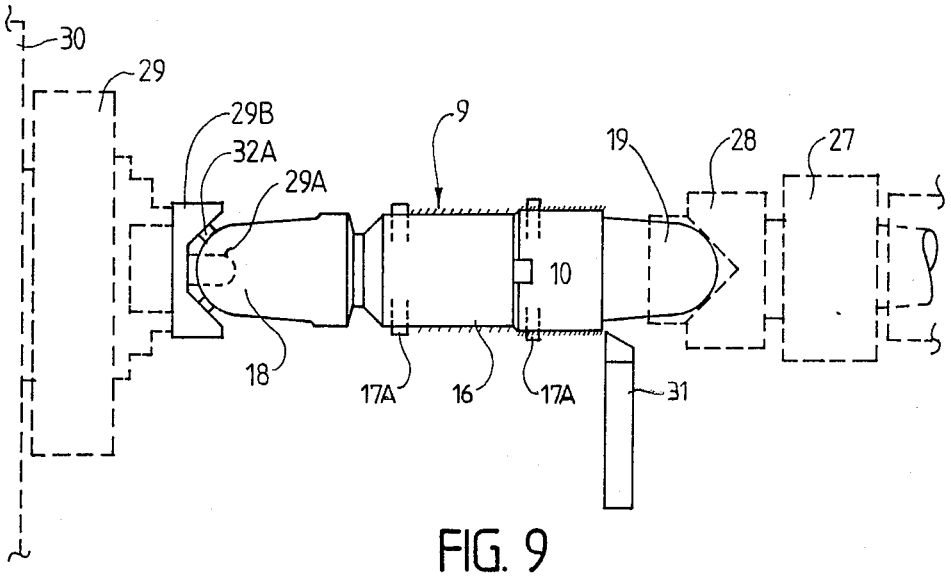
Figures 10, 11, 12, 13:
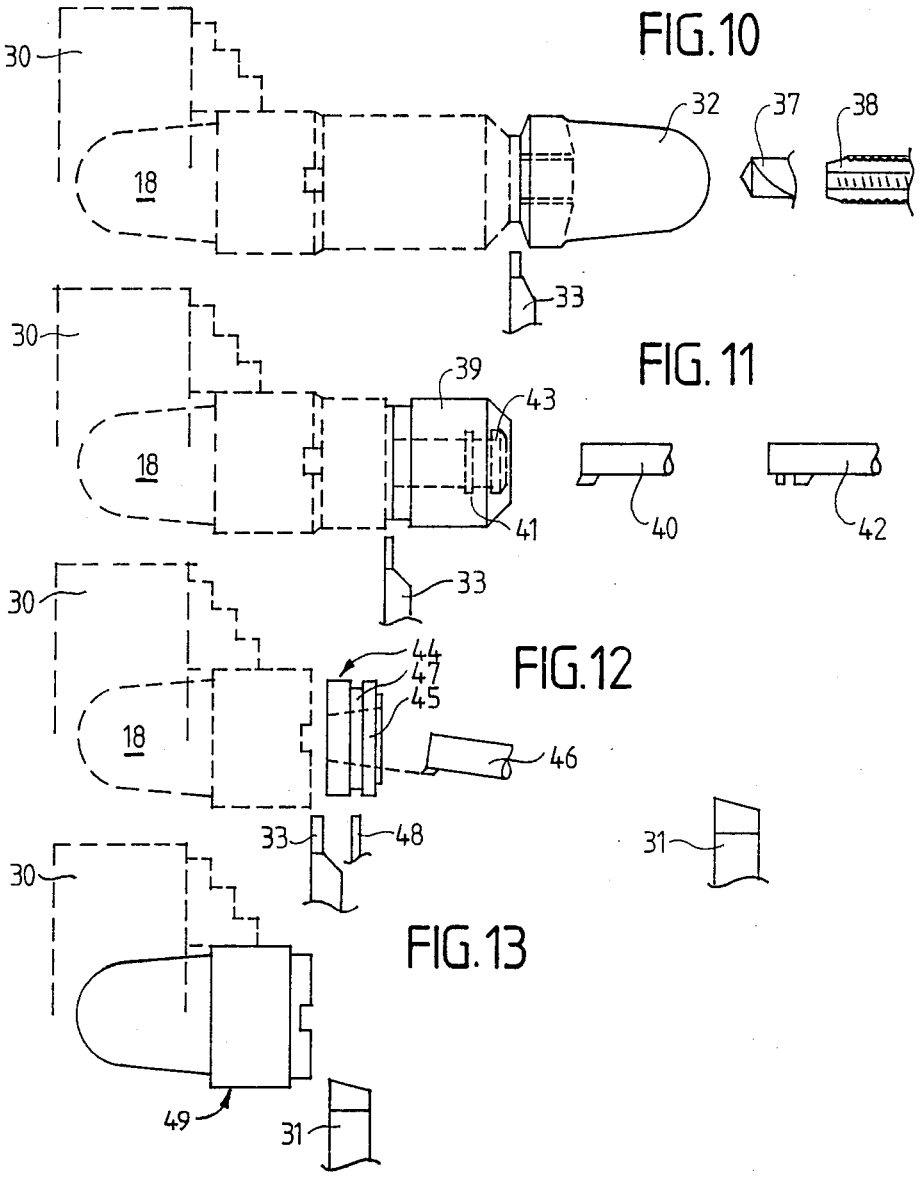
Figure 14:
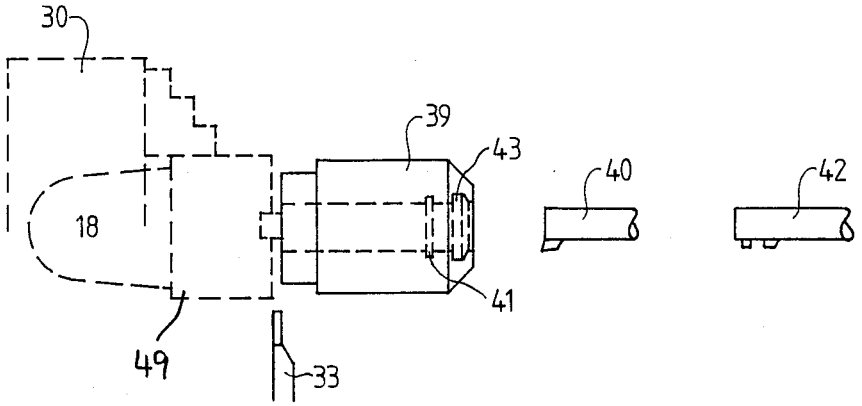
Figure 15:
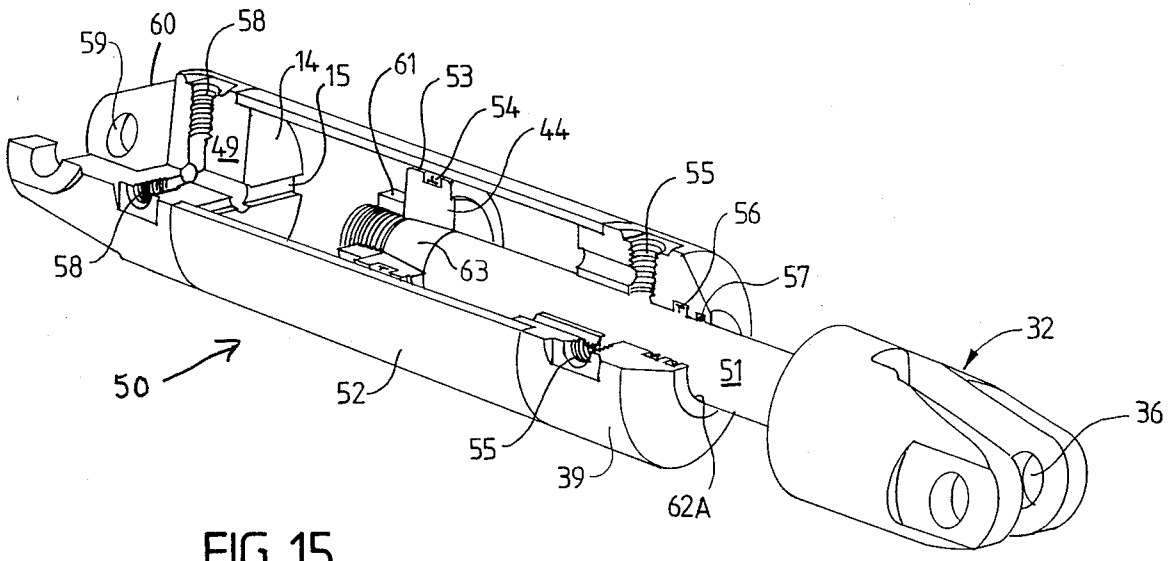
Figure 19:
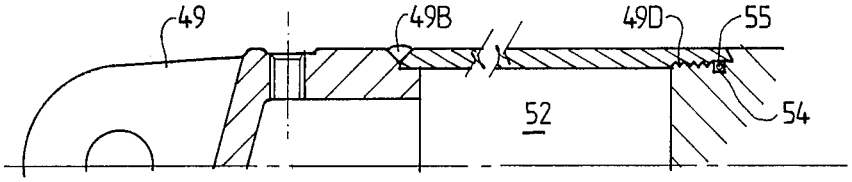
Figure 20:
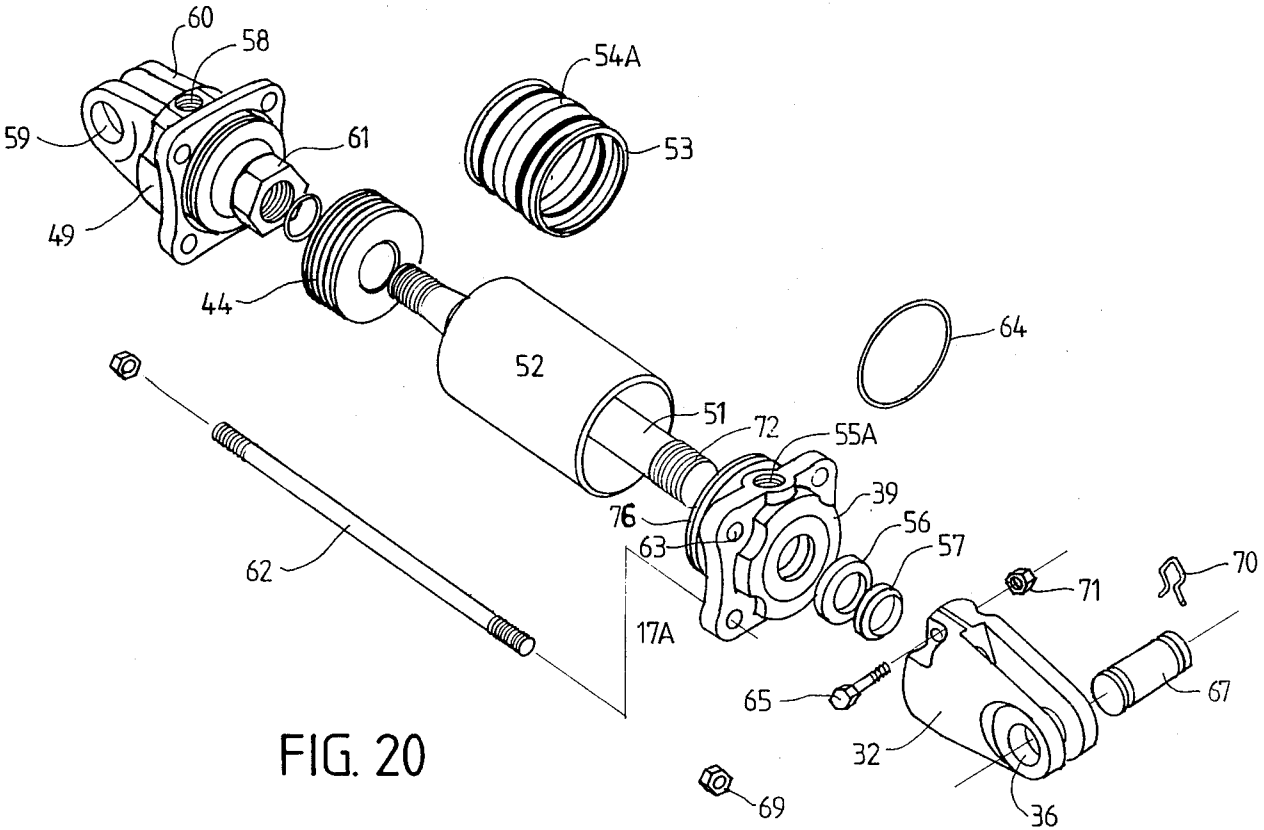
Figure 21:
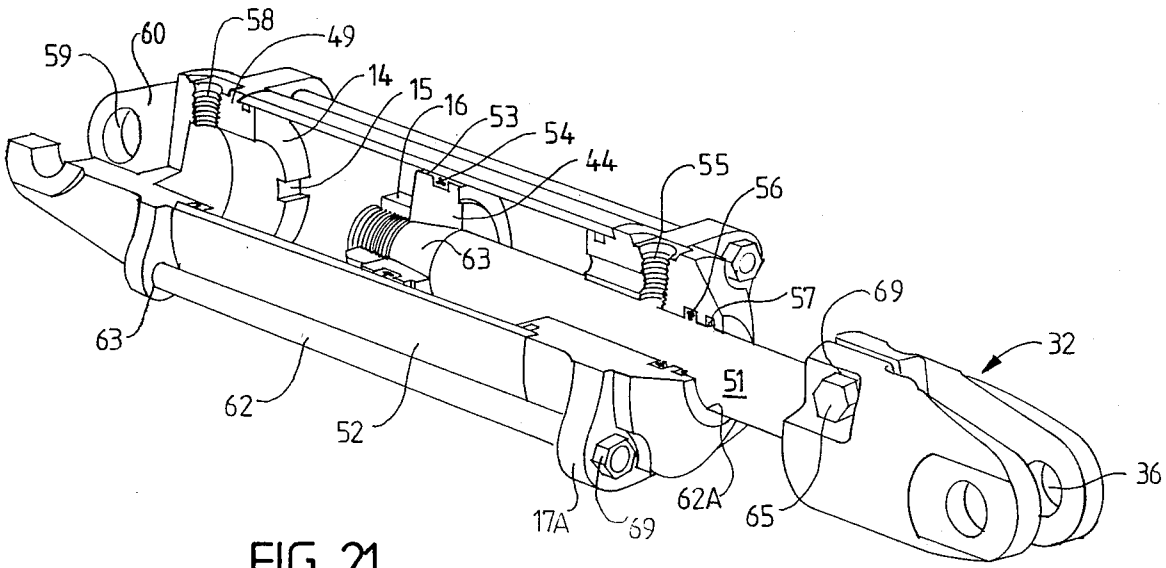
Figures 22, 23, 24:
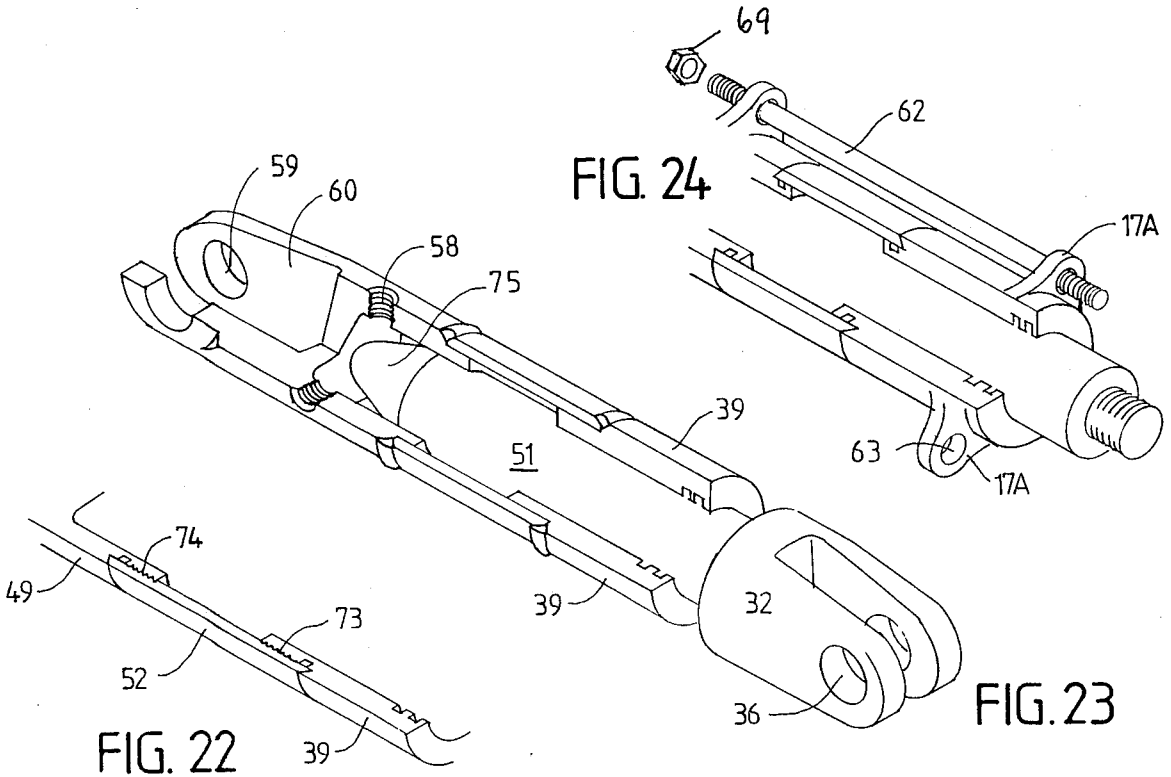

FIG. 7; is a view showing the casting supported on a drilling and tapping stand for drilling and tapping operations;

FIGS. 8 and 9 are schematic views of the casting supported on the lathe prior to the parting off operations;

FIG. 10 is a schematic view similar to FIG. 8 showing the drilling and tapping operation necessary to form the rod clevis;

FIG. 11 is a schematic view similar to FIG. 8 showing that formation of the front end cap;

FIG. 12 is a schematic view similar to FIG. 8 showing the formation of the piston;

FIG. 13 is a schematic view similar to FIG. 8 showing the formation of the rear end cap; and FIG. 14 is a schematic view similar to FIG. 8 showing formation of a single acting hydraulic ram assembly;

FIG. 15 is a perspective view of a hydraulic ram assembly constructed by the method of the invention;

FIGS. 16–19 show varying arrangements in schematic form of the interconnection between the cylindrical tube and front end cap and rear end cap;

FIG. 20 shows an exploded perspective view of a hydraulic ram assembly constructed in accordance with the invention;

FIG. 21 shows a prespective view of the assembled hyraulic ram assembly shown in FIG. 19;

FIG. 22–24 shows various forms of a single acting hydraulic ram assembly constructed in accordance with the invention; and The casting 9 shown in FIGS. 1–2 includes a rear portion 10, locating flats 11 and 12 for defining front and rear ports, internal bore 13, end wall 14 having locating and centering groove 15, barrel portion 16, boundary groove 17, front bifurcated end 18 and rear bifurcated end 19.

In FIGS. 3–4 there are also shown tie bolt securing lugs 17A in the form of a continous outwardly extending rib of casting 9 together with adjacent cavities 18A for tie bolts (not shown). Also shown are opposed apertures 19A for a cross bolt facility.

Figure 5:
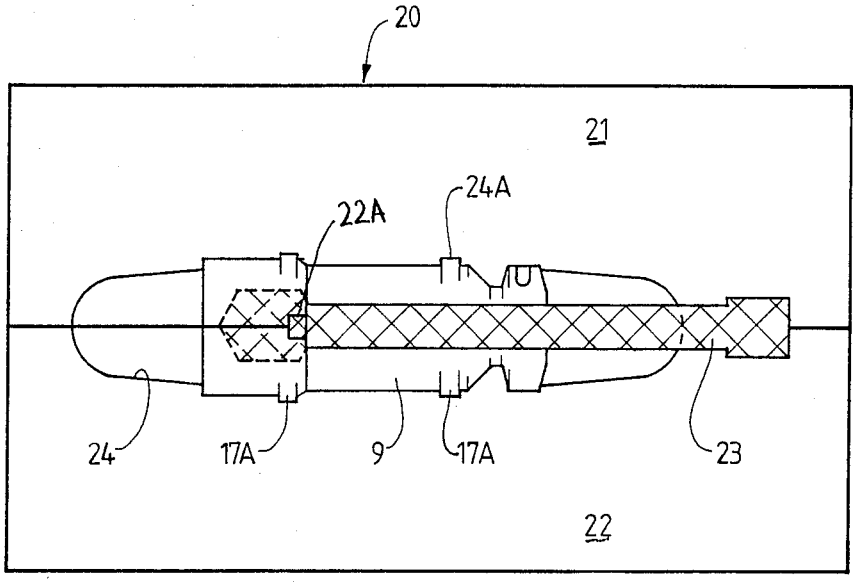
FIG. 5 is a sectional view of the mould for forming the casting.
Figure 6:
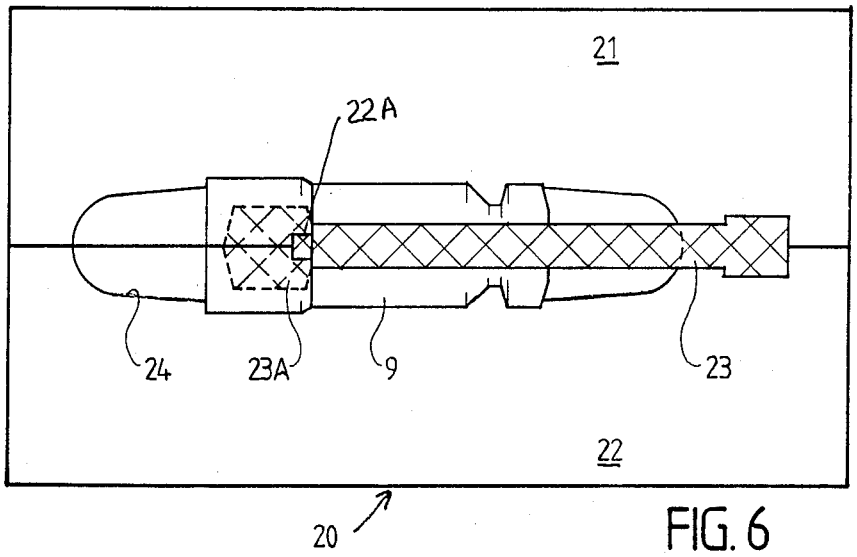
FIG. 6 is a similar view to FIG. 5 showing a modified mould.

In FIGS. 5–6 the mould 20 includes upper component 21, bottom component 22, core 23 and the casting 9 contained in the mould cavity 24. The core 23 forms the internal bore 13 of the casting 9 and the mould cavity is also responsible for formation of grooves 15 and 17 and recesses 25 and flats 26 of both bifurcated ends 18 and 19 of casting 9. Also shown are grooves 24A for forming ribs 17A and enlarged part 23A of core 23 for forming the internal bore of the rear end cap part 22A of core 23 forms groove 15.

In FIG. 7 there is shown drilling and tapping stand 27A for supporting casting 9 in a vertical attitude although casting 9 could be supported in a horizontal attitude if required. Also shown are locking screws 28A, locating pins 29A, and opposed V blocks 30A and 31A. Also shown are hardened clamp pads 32A as well as clevis hole drill 33A for drilling holes 34A top and bottom in casting 9 as shown. Also shown is port drill and spotface 35A and port tap 36A for tapping fluid ports 58 in casting 9. Stand 27A is indexable or rotatable in 90 degrees increments.

In FIGS. 8–9 the casting 9 is initially supported in a lathe as shown wherein the rear end 19 is supported in a tailstock 27 of the lathe by a rotatably mounted centering device 28. The lathe chuck 29 of headstock 30 supports front end 18 as shown. A turning tool 31 initially fettles or machines rear end cap portion 10 as shown or barrel portion 16 as well if required (shown in dotted outline) dugs 17A may be retained or shorn off if desired.

In FIG. 9 there is also shown casting 9 supported in V-block 29B with hardened clamp pads 32A. Also shown is locating pine 29A.

In FIG. 10 the orientation of casting 9 in the lathe is reversed. The rod clevis 32 is formed by a part-off tool 33 as shown. Apertures 36 in rod clevis 32 may be formed by a drilling tool 37 and tapping tool 38 if the embodiment of FIG. 7 is not used.

In FIG. 11 the front end cap 39 may be formed by part-off tool 33. The front end cap 39 may have a boring tool 40 to form an internal bore thereof and grooves 41 and 43 may be formed by grooving tool 42.

In FIG. 12 the piston 44 may have a tapered internal bore 45 formed by taper boring tool 46. The groove 47 of piston 44 may be formed by grooving tool 48 and piston 44 may be separated from rear end cap 49 by part-off tool 33. When still supported in the lathe the rear end cap 49 as shown in FIG. 13 may be dressed by turning tool 31 which also may be used to machine piston 44 as shown in FIG. 12.

In FIG. 14 there is shown the necessary step of forming a single acting hydraulic ram assembly wherein the operations in FIGS. 11–12 are omitted and part off tool 33 separates front end. cap 39 and rear end cap 49 as shown with front end cap being formed by tools 40 and 42 as described above before proceeding to FIG. 13. Thus in regard to a single acting assembly the necessary operations are shown sequentially in FIG. 10, FIG. 14 and finally FIG. 13 with piston 44 being omitted.

The hydraulic ram assembly 50 shown in FIG. 15 includes rod clevis 32, apertures or pin holes 36, piston rod 51, front end cap 39, cylindrical tube 52, piston 44, piston wear ring 53, piston seal 54, front ports 55, rod seal 56, rod wiper 57, rear end cap 49, rear ports 58, apertures or pin holes 59 of rear end cap clevis 60 and piston retaining nut 61 attached to piston rod 51.

The ram assembly 50 may be assembled by:

(i) welding front end cap 39 to tube 52;
(ii) fitting seal 56 and wiper 57 to front end cap 39;
(iii) attaching rod clevis 32 to piston rod 51;
(iv) passing piston rod 51 through internal bore 62A of rear end cap 49 and hence into tube 52;
(v) attaching piston seal 54 and wear ring 53 to piston 44 and passing piston 44 into tube 52 through the rear end thereof and subsequently passing over the adjacent tapered end 63 of piston rod 51;
(vi) attaching nut 61 to rod 51;
(vii) withdrawing piston 44 to the front end of tube 52; and
(viii) welding rear end cap 49 to tube 52.

The invention also includes within its scope the casting per se.

The process of the invention is extremely advantageous in that it enables the production of hydraulic ram assemblies to be produced in an efficient and extremely cost effective manner while at the same time maintaining proper tolerances and alignment including concentricity between components.

In a variation of the process as described above it will be appreciated that the front end cap 39 may be obtained from another source and in one form for example may be screw threadedly attached to a cylinder tube or welded thereto. In this embodiment the raw casting may comprise rod clevis 32, piston 44 and rear end cap 49. Piston 44 may also be omitted for a single acting cylinder as described above.

Also in relation to formation of ram assembly 50 as described above front end cap 39 may be screw threadedly attached to tube 52 instead of being welded thereto if desired.

In another variation of the invention the raw casting may be produced from a mould without having an internal bore which may be formed in the casting separately by a machining or boring tool. However it is preferred that the internal bore be formed in the mould as previously described.

In another embodiment of the invention the rear end cap 49 may be screw threadedly attached to an adjacent cylinder tube 52.

Figure 16:
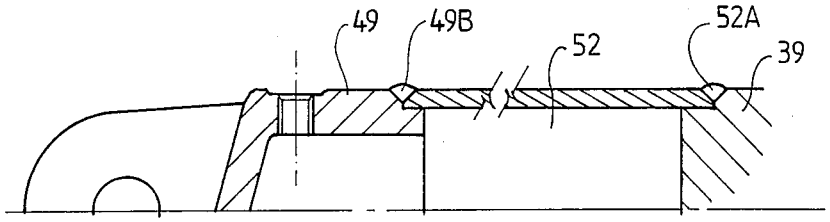

In FIG. 16 there is shown rear end cap 49 welded to tube 52 at 49B and front end cap 39 welded to tube 52 at 52A.

Figure 17:
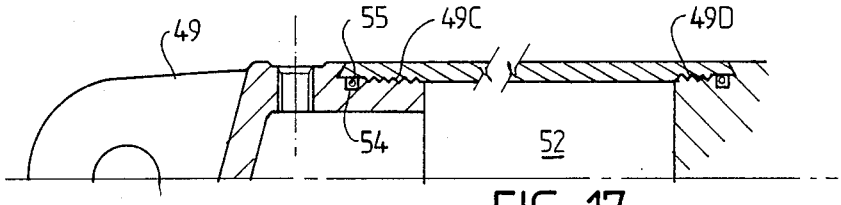
Figure 18:
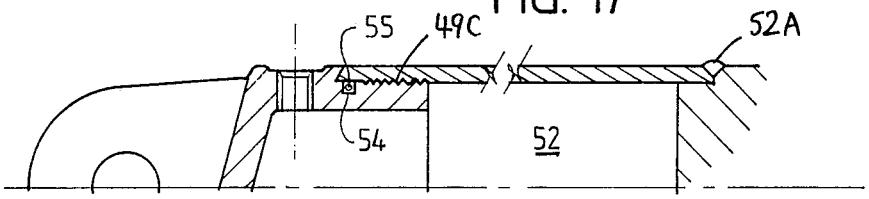

In FIG. 17 there is shown rear end cap 49 screw threadedly attached to tube 52 at 49C and front end cap 39 screw threadedly attached to tube 52 at 49D. FIG. 18 shows rear end cap 49 screw threadedly attached to tube 52 at 49C and front end cap 39 welded thereto at 52A. FIG. 19 shows a reverse situation to that of FIG. 18. Also shown are sealing rings 55 and associated retaining grooves 54.

In FIG. 20 an exploded perspective view of a hydraulic ram assembly different to that shown in FIG. 15 is illustrated. Features common to FIG. 15 are identified by the same reference numerals. There is also shown tie rod 62, apertures 63 in securing lugs 17A for tie rods 62, front end cap sealing ring 64, front clevis bolt 65, clevis pin 67 and tie rod nuts 69. Also shown in clip 70 and nut 71 for front clevis bolt 65. Four tie bolts 62 may be used if required.

FIG. 20 shows a schematic view of a hydraulic ram assembly constructed in accordance with the invention wherein front clevis or rod clevis 32 is screw threadedly attached to piston rod 51 at 72. However front end cap 39 may be attached to barrel or tube 52 and rear end cap 49 may be attached to tube 52 as shown previously by tie bolts 62. The assembly shown in FIG. 20 may be assembled by the following steps:

(a) screw threadedly attaching rod clevis 32 to piston rod 51;
(b) sliding piston rod 51 through front end cap 39 which is then slidably mounted thereon;
(c) sliding piston 44 onto rod 51 and then attaching nut 61;
(d) sliding barrel 52 over piston 44 until it abuts spigot 76;
(e) engaging rear end cap 49 with barrel 52 and front end cap 39 with barrel 52 and attaching the whole assembly by the rods 62.

Steps (e) and (f) may be replaced by screw threaded or welded attachment between barrel 52 and front end cap 39 and rear end cap 49 as described previously. The fully welded version is disposable.

In FIG. 21 the assembled hydraulic cylinder assembly from the components shown in FIG. 20 is illustrated.

FIGS. 22–24 show a single acting hydraulic ram assembly in accordance with the invention. FIG. 22 illustrates an assembly where front end cap 39 and rear end cap 49 are screw threadedly attached to barrel 52 at 73 and 74 respectively. FIG. 23 illustrates a fully welded version wherein piston rod 51 does not have a piston 44 in the case of the double acting versions shown previously and has a tapered end 75. FIG. 24 shows a tie rod version wherein lugs 17A are included together with tie rods 62 which extend through apertures 63 and retained by nuts 69 as described previously.

I claim:

1. A raw casting for a fluid actuated ram assembly comprising (i) a rear portion having a bifurcated end; and (ii) a barrel portion including an internal bore; and (iii) a front portion having a bifurcated end.

2. A raw casting as claimed in claim 1 wherein the rear portion is provided with one or more locating flats so as to define locations for one or more fluid ports.

3. A raw casting as claimed in claim 1 wherein the barrel portion has an end wall formed by the rear portion having a locating and centering groove.

4. A raw casting as claimed in claim 1 wherein the barrel portion has one or more locating flats defining fluid ports.

5. A raw casting as claimed in claim 1 wherein the casting includes an external groove separating the front portion and the barrel portion.

6. A raw casting as claimed in claim 1 wherein bifurcated end of the rear portion has a pair of opposed branches each having on an external surface thereof a locating flat wherein each locating flat is in substantial alignment for subsequent drilling of opposed apertures.

7. A raw casting as claimed in claim 1 wherein the bifurcated end of the front portion has a pair of opposed branches each having on an external surface thereof a locating flat wherein each locating flat is in substantial alignment for subsequent drilling of opposed apertures.

* * * * *